US007145065B2

(12) United States Patent
Geier

(10) Patent No.: US 7,145,065 B2
(45) Date of Patent: Dec. 5, 2006

(54) RELEASABLE TREMOLO LOCK DEVICE

(76) Inventor: Kevan J. Geier, 1330 Bayboro Dr., New Albany, OH (US) 43054

( * ) Notice: Subject to any disclaimer, the term of this patent is extended or adjusted under 35 U.S.C. 154(b) by 492 days.

(21) Appl. No.: 10/464,331

(22) Filed: Jun. 18, 2003

(65) Prior Publication Data

US 2004/0255752 A1 Dec. 23, 2004

(51) Int. Cl.
*G10D 3/00* (2006.01)

(52) U.S. Cl. ..... 84/313

(58) Field of Classification Search ..... 84/313, 84/297 R, 298, 299, 307, 312 R
See application file for complete search history.

(56) References Cited

U.S. PATENT DOCUMENTS

| | | | |
|---|---|---|---|
| 4,171,661 | A | 10/1979 | Rose |
| 4,457,201 | A | 7/1984 | Storey |
| 4,487,100 | A | 12/1984 | Storey |
| 4,697,493 | A | 10/1987 | Ralston |
| 4,709,612 | A | 12/1987 | Wilkinson |
| 4,852,448 | A | 8/1989 | Hennessey |
| 4,892,025 | A | 1/1990 | Steinberger |
| 5,088,375 | A | 2/1992 | Saijo |
| 5,522,298 | A | 6/1996 | Schaller et al. |
| 5,708,225 | A | 1/1998 | Sherman |
| 5,986,190 | A | 11/1999 | Wolff et al. |
| 5,986,192 | A | 11/1999 | Wingfield et al. |
| 6,420,639 | B1 | 7/2002 | Sherlock |
| 2004/0083875 | A1* | 5/2004 | Burton ..... 84/401 |

FOREIGN PATENT DOCUMENTS

| | | | | |
|---|---|---|---|---|
| JP | 2003005751 | * | 1/2003 | ..... 84/267 |

* cited by examiner

*Primary Examiner*—Kimberly Lockett
(74) *Attorney, Agent, or Firm*—The Webb Law Firm

(57) ABSTRACT

A quick-release tremolo lock device for installation into a tremolo or vibrato assembly recess or cavity, and for mounting to a movable bridge or a tremolo or vibrato block of a stringed instrument such as a guitar. The tremolo lock device includes a spring mount that is adapted to be fixedly attached to at least one wall of the tremolo or vibrato cavity to prevent relative motion between the spring mount and the cavity. The spring mount is also configured to capture an end of at least one tremolo or vibrato return spring. A slide key is also incorporated into the quick-release lock device, which is connected to the spring mount about a proximate portion of the slide key. The releasable tremolo lock device is also adapted with an adjustable quick release slide receiver that is adapted to receive and to releasably capture a distal portion of the slide key to, when engaged, capture and fix the position of the receiver relative to the slide key. A tail piece member is also part of the lock device and is joined to the quick release slide receiver. The tail piece is further configured to be mounted in the tremolo recess to the tremolo block of the guitar. In any of the embodiments of the invention, the lock device may also incorporate various types of joints that are adapted for movement in multiple degrees of freedom to compensate for natural and induced misalignment between the tremolo block, the recess wall, and the tremolo lock device.

20 Claims, 10 Drawing Sheets

FIG. 6
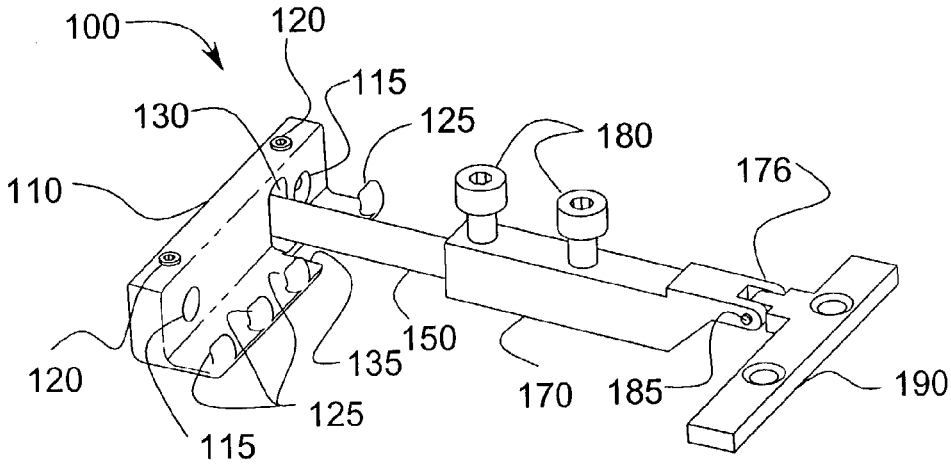
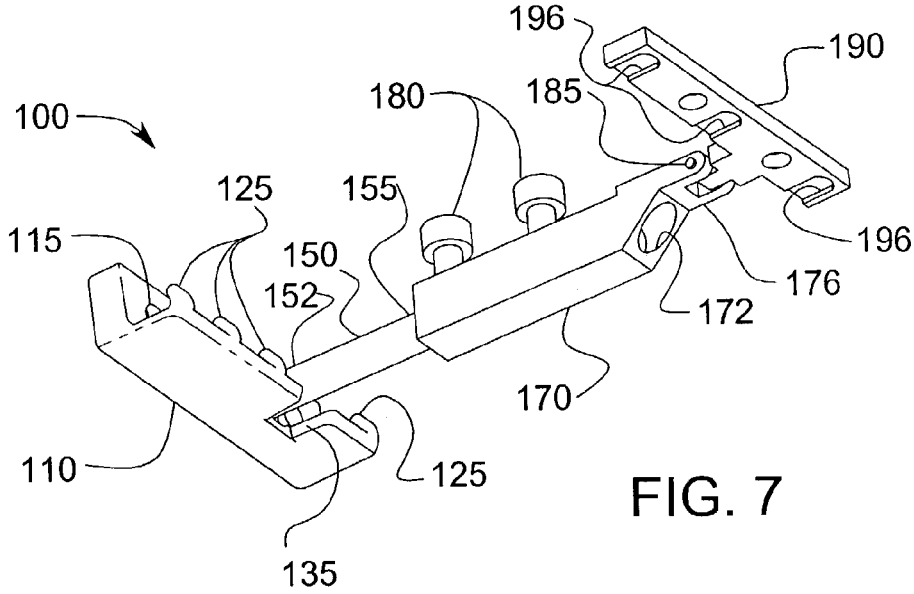
FIG. 7

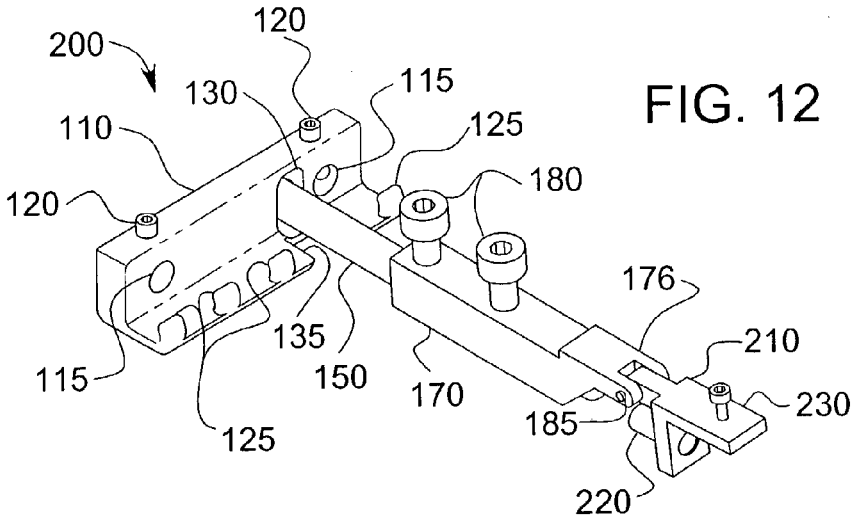
FIG. 12
FIG. 13
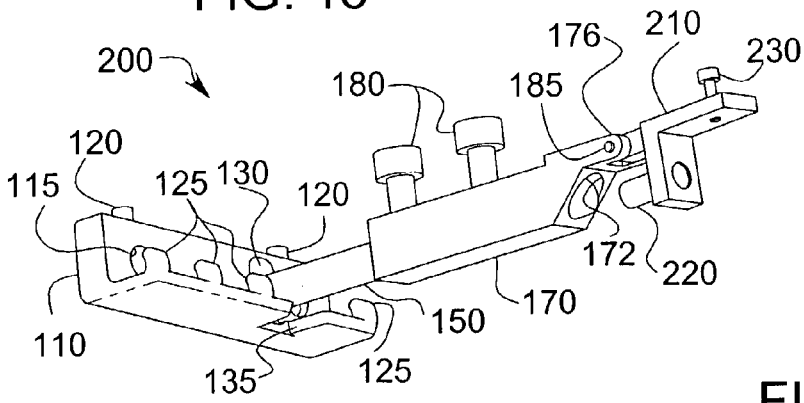
FIG. 14
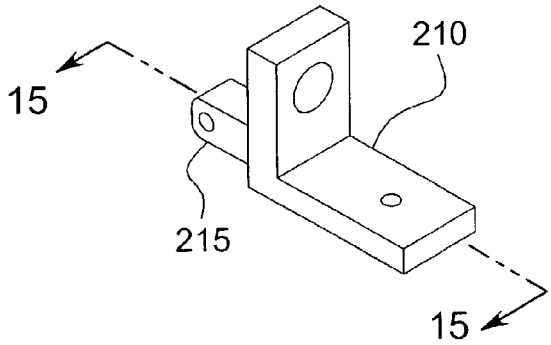
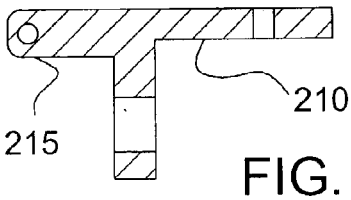
FIG. 15

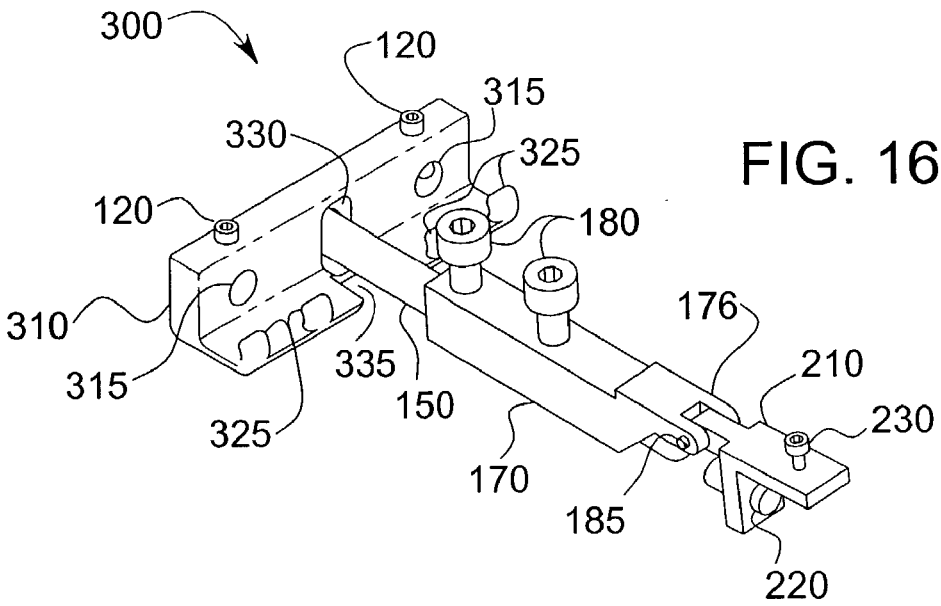
FIG. 16
FIG. 17
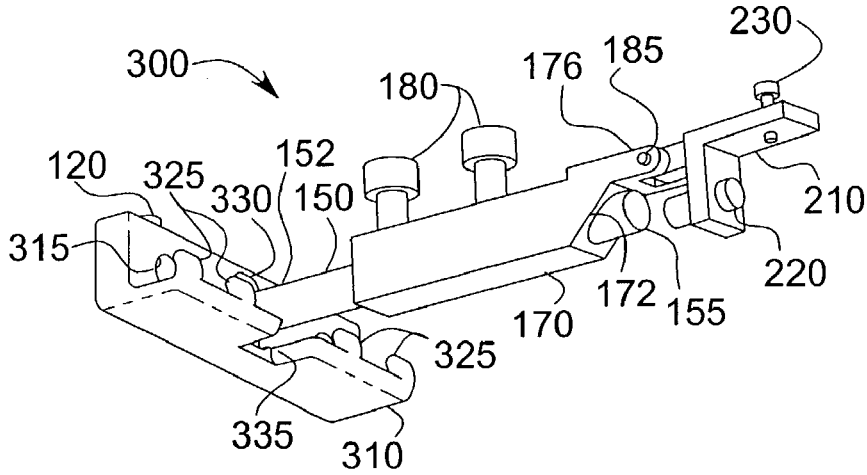

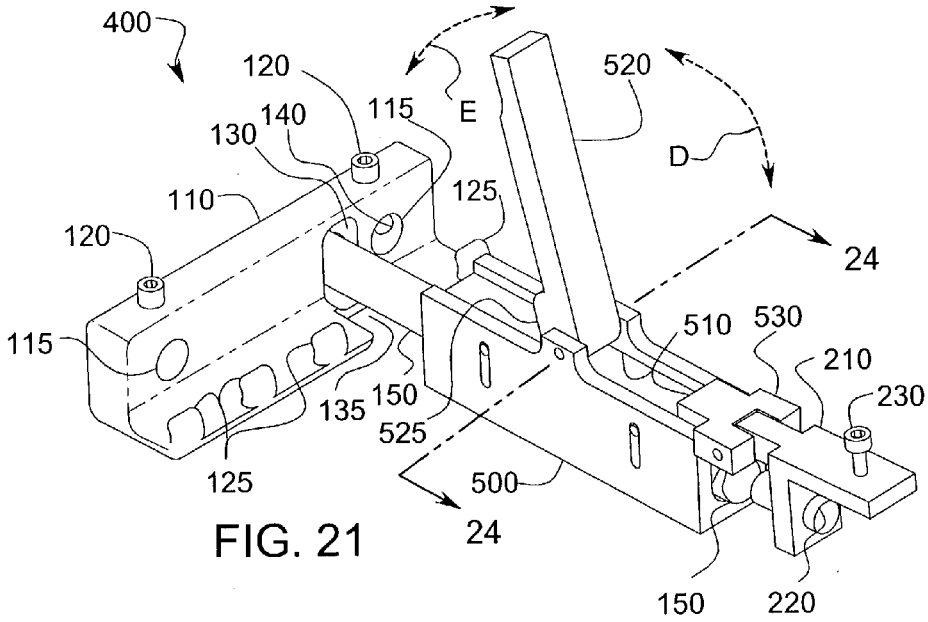
FIG. 21
FIG. 22
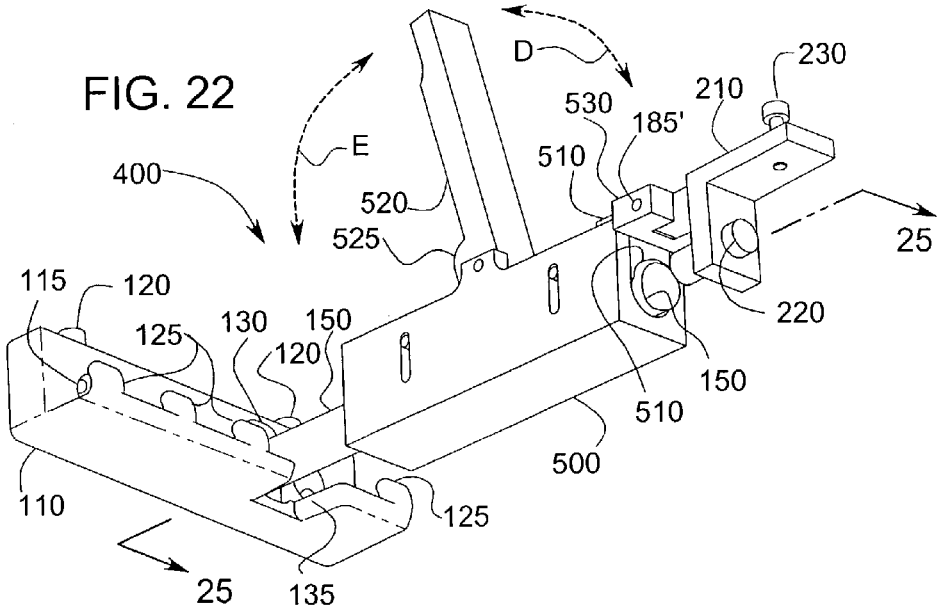

RELEASABLE TREMOLO LOCK DEVICE

TECHNICAL FIELD

This invention relates to stabilization and locking devices for a tremolo or vibrato pitch manipulation system for a stringed instrument including, for purposes of illustration but not for purposes of limitation, those instruments in the lute family of instruments and also including for purposes of further examples the acoustic guitar, balalaika, banjo, cithara, cithern, electric guitar, gittern, guitar, mandolin, samisen, semi-acoustic guitar, ukulele, zither, modified violin, fiddle, rebec, piano, harp, dulcimer, harpsichord, cembalo, spinet, clavichord, and related string instruments.

BACKGROUND OF THE INVENTION

For as long as stringed instruments have existed, designers, manufacturers, performers, and composers have sought to innovate the means by which the sound can be artistically varied during performances. Over the centuries, various means have been adopted and incorporated into such stringed instruments to enhance and modify the sound producing capabilities of the instruments. Many such stringed instruments are fabricated to include a generally elongated body strung with a number of gut, nylon, and or metal strings fixed to a bridge and tailpiece mounted on a sound board at one end and to tuning screws at an opposite end, and with pitch adjusting frets therebetween. In acoustic stringed instruments, a sound hole is generally placed close to the strings and near the bridge and tail piece so that sound vibrations from the strings resonate into a hollow body formed beneath the sound board. Thus, the sound vibrations are transmitted into the hollow body both through the sound hole and through the sound board mounted bridge.

In the 1930s, American manufacturers and musicians expanded the repertoire of stringed instruments and developed electric guitars and other electrically augmented stringed instruments, which matured generally into instruments that replaced the generally hollow and resonating body of the instrument with a solid body so as to minimize electrical feedback of the resonating sound. In place of the hollow body, the electric guitar, among other instruments was then fitted with electrically activated pickups that are placed on the sound board beneath the strings, and which convert the sound energy of the resonating strings into electrical impulses that are then amplified and electrically manipulated during performances.

As the electric guitar and other electrically-augmented string instrument designs matured, additional technologies were incorporated and included, among others, tremolo, trill, and vibrato effects. What has traditionally become known in the electric guitar and related instrument industries as a tremulous, vibrato, and or tremolo effect, is induced in a number of various ways that can include modifications made to the tuning screws, frets, fingerboards, sound board, and bridge and tail piece assembly.

In the most commonly employed tremolo and vibrato effects, especially in electric guitar applications, the integral and or separate bridge and tail piece are often modified wherein one or both pieces are adapted to be movable so as to adjust the length of the tuned strings during performances, which thereby variably adjusts the pitch and tone of the sounds produced by the vibrating and resonating strings. The bridge or tailpiece, or combined bridge-tailpiece is typically modified to incorporate a tremolo actuation handle or bar, which is commonly referred to by those in the field simply as a tremolo bar or trem-bar. During actuation of the tremolo or vibrato effect, the performer manipulates the tremolo bar that operates to rock the bridge or tail piece or combined unit about the pivot or fulcrum member to variably shorten or lengthen the strings, which thereby changes the string tension and adjusts the pitch or tone of the sounds of the notes played on the resonating strings. This tremolo effect and or movable bridge-tailpiece assembly is often collectively also referred to by those skilled in the art as a "tremolo block" or "trem-block," which is used in context to distinguish from the tremolo actuation bar, trem-bar, or handle described with similar language hereinabove.

The bridge and or tailpiece, or integral tremolo block is/are further modified so that a portion thereof extends into a recess of the solid body of the guitar, and to project across a pivot or fulcrum member so as to establish a lever action in the modified bridge assembly or tremolo block. On the opposite side of the pivot or fulcrum member, the bridge or trem-block is attached to one or more biasing members, elements, or return springs (compression or tension) that are adapted to operate in a number of possible configurations.

In one possible configuration, the biasing members are compression or tension springs that are adapted, in their unactuated position, to fix the position of the bridge or trem-block, and to urge the bridge or trem-block into an at rest or equilibrium orientation against a surface of the instrument whereby the strings will be balanced in tension, across the bridge or tail piece assembly, and against the spring force to produce unmodified notes and sounds as established during tuning of each string. In this configuration where the trem-block is urged against a surface of the instrument, the musician typically can only actuate the tremolo effect assembly to either raise or to lower the pitch or tone of the notes played on the strings, but not both.

In the more commonly practiced and more modern tremolo effect assemblies, the bridge or trem-block is adapted to be actuated so that the performer can both raise or lower the pitch or tone of the notes played on the strings, which is commonly referred to by performers as "bending" the notes. In this arrangement, the bridge and springs are configured so as to position the tremolo block or movable bridge in a substantially centered, equilibrium position whereby the tension established by the tuned strings of the instrument is balanced against the tension (or in certain configurations the compression) of the tremolo springs.

In this instant configuration, the performer actuates the tremolo bar or handle to bend the played notes, that is, to raise or lower the pitch or tone of the played note of the strings, by effectively increasing or decreasing the length of the strings while a passage is played. Various embodiments of tremolo effect assemblies are known to those skilled in the art and some are described in U.S. Pat. Nos. 4,457,201 & 4,487,100 to Storey; U.S. Pat. No. 4,171,661 to Rose; U.S. Pat. No. 4,709,612 to Wilkinson; U.S. Pat. No. 4,892,025 to Steinberger; U.S. Pat. No. 4,852,448 to Hennessey; U.S. Pat. No. 5,522,298 to Schaller et al.; U.S. Pat. No. 5,708,225 to Sherman; and in U.S. Pat. No. 5,986,190 to Wolff et al, which are each hereby incorporated by reference in their entirety. As can be appreciated by those having skill in the relevant arts, the tremolo effect assemblies described here rely on the balance between the force exerted by the properly tuned strings and the force imparted by the tremolo springs. If a string or a spring becomes detached or is broken, the instrument becomes unusable until the forces are rebalanced either by retuning and or retensioning the remaining strings and or springs, or by replacement of the unserviceable string or spring.

When a tremolo effect assembly is incorporated into the design of a stringed instrument, it has been found advantageous to also include a releasable locking mechanism that can be engaged to lock the tremolo effect assembly into a preferred position. In some embodiments, the tremolo locking mechanism is adapted to lock the strings into an alternative pitch or tone position, which operates much like the more commonly used capo devices that adjust the string octaves along the fingerboards or frets of guitar-like string instruments. In other embodiments, the tremolo effect assembly is locked into a neutral or unactuated position that prevents inadvertent or unwanted tremolo actuation during performance of a passage that does not require use of the tremolo effect assembly. In many of such locking mechanism embodiments, it is noted that the locking feature can render the instrument usable at least in partial performance modes of operation because in the event that a string or spring breaks or becomes otherwise unserviceable, the tremolo effect assembly can be locked in a position that renders the strings usable with perhaps only a slight adjustment, if any is needed.

Many attempts have been made in the prior art to achieve a satisfactory tremolo effect assembly locking device. Some tremolo assembly locking devices that have been attempted by others are described in, among other patents, U.S. Pat. No. 4,697,493 to Ralston; U.S. Pat. No. 5,088,375 to Saijo; and in U.S. Pat. No. 5,986,192 to Wingfield et al. One or more of these and other references have observed and explained that the most desirable locking devices should not impede the performance capabilities and playability of the stringed instrument to which the contemplated devices are attached. However, each such locking device demonstrates many shortcomings that do not effectively overcome the stated goals and objectives and conceded problems set forth in the prior art references of record.

More particularly, it has been observed that a tremolo effect assembly locking mechanism, whether engaged or disengaged, should not interfere with the performance capability, i.e. playability, of the stringed instrument. Some of the devices contemplated in the prior art are directed to locking mechanisms that can only be mounted to the front of the sound board of the instrument, which requires substantial modifications to original equipment as delivered from the manufacturer. Other devices are limited to custom fabricated bridge assemblies that establish the desired tremolo effect, which requires expensive, and often prohibitively costly, redesign of existing assemblies. In all such proposed and contemplated tremolo effect locking devices, what has been missing and long-needed is a tremolo assembly or movable bridge assembly or tremolo block locking mechanism that not only incorporates the benefits of the prior art devices, but which also overcomes the problems in the art in a way that is compatible for use with any number of stringed instruments.

Even more specifically, what is needed is a locking mechanism for a tremolo block or movable bridge assembly that can be used by any stringed instrument musician and that does not require modification of the instrument and which does not require custom-manufactured instruments to be factory-made to include the inventive tremolo locking device. That is, the preferred inventive device must be compatible for use with legacy stringed instruments in a way that not only avoids the need for modifications to the target instrument, but which also does not impede the playability or the appearance thereof.

To restate this long-felt but unaddressed problem with prior art locking devices, what has long been missing in the stringed instrument industry, is a tremolo block locking device that is compatible for use with the widest range of industry standard tremolo effect assemblies, including the standard return springs, and other components, and which can be implemented by those having only ordinary skill in the performing arts without modifications to the target stringed instrument. Among other needs and problems, it is an especially important need in the field of stringed instruments, including for example electric guitars, to avoid any modifications to the factory delivered instrument or the instrument that has accumulated substantial acclaim and or nostalgic value by virtue its having been fabricated by an acclaimed artisan, or by virtue of its use in an acclaimed performance or use by a famous musical artist or use on a specific date of importance.

In any such circumstances, the instruments can acquire significant economic and sentimental value to their owners, which weighs against any modifications to the instruments. With the known prior art locking mechanisms of record here, if the locking mechanism is compatible for use with industry standard instruments, modifications to the instrument are usually required before the lock can be used. However, in view of the preceding considerations, modifications are likely to diminish the value of the instrument. Even so, the instrument owner often finds it is extremely desirable to perform musical passages on such instruments, and many such passages often incorporate or require tremolo and or vibrato effects for a performance that matches, mimics, or tracks that of the original performer or author.

With these considerations in mind, those skilled in the arts may be able to comprehend that it is often desirable to incorporate a locking device for a tremolo effect or a movable bridge assembly that can be installed without modifications to the original instrument and in a configuration that does not detract from the appearance of the instrument, which does not add undesirable weight to the instrument, and which does not affect playability during performances. Additionally, it is desirable to incorporate a tremolo effect locking device that is quickly and easily engaged and disengaged by the musician's hand during and or between performances in a way that does not impair or detract from the performance. The ideal device would also be capable of simplified removal, replacement, and modification without substantial effort and by lay individuals as well as accomplished technicians and performers. Accordingly, the instant invention accomplishes these and other goals and objectives in new and novel ways that overcome the problems and shortcomings in the prior art locking devices for tremolo effect moving bridge assemblies.

The present invention meets these and other needs and is perhaps the most widely-compatible and most easily adapted and installed tremolo assembly locking device ever devised. The releasable locking device according to the principles of the instant invention accomplishes these and other objectives with most industry standard stringed instruments and especially acoustic and electric guitars and related instruments, whether customer manufactured or mass-produced, and the inventive device does not add any significant costs or increased difficulties in the manufacture or use thereof.

SUMMARY OF INVENTION

In its most general configuration, the present invention addresses the problems in the art and advances the state of the relevant technology with a variety of new features and capabilities that improve prior devices in new and novel ways, and which are all compatible for use with the widest possible cross-section of prior art stringed instruments, including guitars and related instruments. In one of the many preferable configurations, a quick-release tremolo lock device according to the principles of the instant invention is disclosed that is compatible for installation into a tremolo or vibrato assembly recess or cavity of a stringed instrument, such as a guitar or other similarly configured stringed instrument. While the contemplated tremolo or vibrato lock device is compatible for and intended to be incorporated into a wide variety of stringed instruments, for purposes of illustration and not for purposes of limitation, the various embodiments will be described in the context of guitars and related stringed instruments.

The inventive quick-release tremolo lock device is preferably adapted to be connected or mounted to a movable bridge or tailpiece assembly, which is also sometimes referred to by those skilled in the art, especially in the guitar and related fields, as a tremolo block or vibrato block. The tremolo lock device is also configured to be connected to a surface of the stringed instrument so as to releasably immobilize the movable bridge or tailpiece assembly, or the tremolo or vibrato block, to prevent relative movement therebetween. In this way, the invention enables the musician to perform musical passages with or without tremolo or vibrato effects while having the confidence that inadvertent actuation will not occur.

The tremolo lock device includes a spring mount member that can be in the form of a bar or block or other elongated or sheet-type material. The spring mount is configured with features that enable it to be firmly and fixedly connected or attached to the surface of the stringed instrument. Typically, in guitar and related instrument applications, the spring mount is adapted to be attached to the preexisting hardware installed by the instrument manufacturer, which is usually at least two wood or machine screws that protrude into a recess or cavity that is formed, for example, about a back side of an electric guitar, or inside the sound box of an acoustic guitar. The spring mount is further configured with fasteners or similar components that can capture the preexisting hardware so that the spring mount can be securely but releasably fixed to the hardware.

In most tremolo or vibrato assemblies, such as those employed in guitar and related stringed instruments, the assemblies incorporate one or usually more biasing members or elements, which are often tension or compression springs. For example, in the most widely-available tremolo and vibrato effect assemblies that are used in electric guitars, at least two and more often three return springs are employed. Accordingly, the preferred spring mount of the inventive tremolo lock device also preferably includes one or more features that are arranged to receive or capture an end of at least one such tremolo or vibrato return spring. In many applications, an even more preferable tremolo lock device will incorporate at least two and possibly even three return spring receiving features, which features can be, for purposes of example without limitation, generally hooked shaped elements, or posts, or claws or other similarly capable features that can receive and retain such springs.

The releasable tremolo lock device also employs a slide key that is joined to the spring mount about an end portion that is proximate to the spring mount. Although a variety of possible joint configurations are contemplated by the instant invention, particularly desirable results have been obtained by configurations of the tremolo lock device wherein the joint between the spring mount and the slide key is capable of movement in one or more degrees of freedom. In stringed instruments such as guitars and the like, the contemplated tremolo or vibrato recess or cavity and the tremolo or vibrato block can be formed with substantial but undesirable misalignment, which can be a result of manufacturing tolerance stack up between various fabrication steps, as well as post-manufacture damage, post-manufacture modifications, natural wear and tear from use, and natural deformation occurring with time in the materials used to construct the instrument. Thus, in some applications, the new and novel tremolo lock device can preferably incorporate joints between components that can compensate for such misalignment by establishing movement therebetween in the noted multiple degrees of freedom. Additionally, in operation, when the proposed inventive tremolo lock device is installed but disengaged, the tremolo function of the host stringed instrument can be employed during performances without impediment.

A quick release slide receiver is also included in the tremolo lock device and is adapted to adjustably cooperate with the slide key to receive a distal portion thereof. When the tremolo lock device is installed and engaged or locked, the quick release slide receiver releasably captures the distal portion of the slide key to fix the position of the receiver relative to the slide key.

The quick release slide receiver is connected to a tail piece that is formed to be attached to the tremolo or vibrato block of the guitar. In any of the many described and otherwise contemplated embodiments of the invention, the tremolo lock device may also further be configured with a joint between the tail piece and the quick release slide receiver that is adapted to establish movement in one or more degrees of freedom between these components, which either alone or in combination with the spring mount-slide key joint, can further compensate for misalignment between the tremolo block, the recess wall, and the components of the tremolo lock device.

In any of the preceding embodiments of the present invention, the releasable tremolo lock device further contemplates a means for releasably fastening and or frictionally engaging the slide key when received within the quick release slide receiver. For purposes of further illustration but not for purposes of limiting the scope of the claimed invention, such means can include various types of latches, twist-locking friction mechanisms, ratcheting and cam-lever mechanisms, and machine screws having keyed or slotted heads or thumb wheel or wing-nut type heads, all of which can facilitate quick and easy engagement and disengagement by a musician during and or between performances.

In any of the many types of possible and preferably fastening means and or frictionally engaging embodiments, the only requirement is that, when so engaged, the slide key is releasably but positively fixed in position relative to the quick release slide key receiver so that the performer can be confident that unexpected tremolo actuation will not occur. For purposes of further explication without limitation, another means for adapting the slide key receiver to frictionally engage the slide key includes an over-center type lever action latch mechanism that, when engaged, frictionally prevents relative movement between the slide key and the receiver.

These variations, modifications, and alterations of the various preferred embodiments may be used either alone or in combination with one another and in combination with other components and devices, as can be better understood by those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures, wherein like reference numerals, and like numerals with primes, across the several drawings, figures, and views refer to identical, corresponding, or equivalent elements, components, features, and parts:

FIG. 6 is an elevated perspective view, in enlarged scale and rotated and with certain structure removed for clarity, of the quick-release tremolo lock device embodiment of FIG. 5;

FIG. 7 is an elevated perspective view, in similar scale and rotated, showing another view of the quick-release tremolo lock device embodiment of FIGS. 5 and 6;

FIG. 12 is an elevated perspective view, in enlarged scale and rotated, of another preferred embodiment, variation, modification, and configuration of the quick-release tremolo lock device according to the principles of the instant invention;

FIG. 13 is an elevated perspective view, in similar scale and rotated, showing another view of the quick-release tremolo lock device variation and embodiment of FIG. 12;

FIG. 14 is a detail view, in enlarged scale and rotated, of a modified tail piece component of the quick-release tremolo lock device embodiment of FIGS. 12 and 13;

FIG. 15 is a section view, in enlarged scale, rotated and taken about section line 15—15 of FIG. 14, of the modified tail piece component of the embodiments of FIGS. 12 through 14;

FIG. 16 is an elevated perspective view, in enlarged scale and rotated, of another preferred variation, modification, configuration, and embodiment of the quick-release tremolo lock device according to the principles of the instant invention;

FIG. 17 is an elevated perspective view, in similar scale and rotated, showing another view of the quick-release tremolo lock device embodiment of FIG. 16;

FIG. 21 is an elevated perspective view, in reduced scale, of an embodiment, variation, and alternative tremolo lock device of the invention and having an alternative slide key receiver according to the principles of the invention and that is contemplated for use with any of the previously described and illustrated variations, modifications, configurations, and embodiments shown here and contemplated hereby;

FIG. 22 is an elevated perspective view, rotated and in similar scale to that in FIG. 21, of the alternative, modified, and additionally preferred tremolo lock device of FIG. 21;

Also, in the various figures and drawings, various reference symbols and letters may be used to identify significant features, dimensions, objects, and arrangements of elements described herein below in connection with the several figures and illustrations.

DESCRIPTION OF THE EMBODIMENTS OF THE INVENTION

In a wide range of possible and contemplated embodiments, modifications, alternatives, and variations and combinations thereof, the present invention is directed to a releasable and quick-release tremolo lock device that establishes new and heretofore unavailable features and capabilities that advance the state of the present technology and art in innovative and unexpected ways. While the various configurations and arrangements of the preferable embodiments are contemplated for use with any number of known and possible stringed instruments, the instant invention is described for purposes of illustration and not for purposes of limitation in the context of modern day electric guitars and similarly capable stringed instruments. Even so, the present invention can be modified and adapted and scaled up or down to be employed in all stringed instruments that employ various means to induce tremolo and vibrato and wavering effects to the sounds produced by the resonating strings during performances.

The instant invention offers several technological advances and solutions to many of the problems and addresses most of the short-comings that have long plagued the art of stringed instruments that incorporate such tremolo and vibrato effects. The improved simplicity of operation and use and the new features and capabilities of the improved quick-release tremolo lock device described herein and contemplated hereby establish a new standard in the field that serves to significantly improve the confidence of and convenience to performers, and which will enable markedly more fluid and uninterrupted performances of musical passages that are interspersed with tremulous effects.

In addition to the performance and playability improving aspects of the instant invention, one the most pronounced benefits of tremolo lock devices according to the principles of the contemplated embodiments includes their compatibility for use and installation in a way that does not alter the appearance of the stringed instruments, and which does not require any modifications whatsoever to be made to such instruments.

Figure 1:
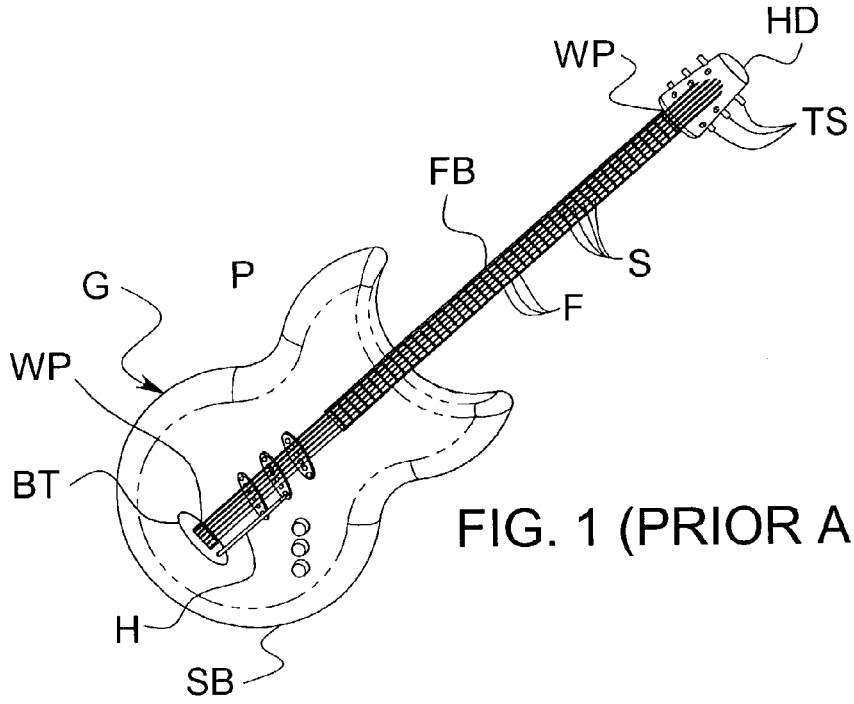
FIG. 1 (PRIOR ART)
FIG. 1 is an elevated perspective view, in reduced scale, of a prior art stringed instrument known to those skilled in the art as an electric guitar.
Figure 2:
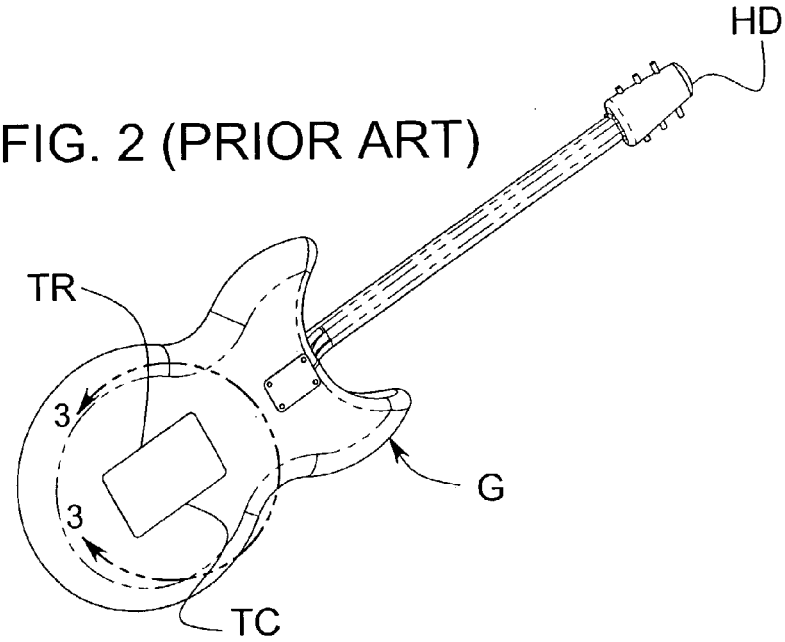
FIG. 2 (PRIOR ART)
FIG. 2 is an elevated perspective view, in reduced scale and rotated, of the back side of the prior art electric guitar of FIG. 1.

With reference now to the various illustrations and particularly to FIGS. 1 and 2, a prior art stringed instrument known to those skilled in the art as an electric guitar G is shown. This typical electric configuration has 6 strings S that are strung and tensioned over frets F of fingerboard FB and pickups P and between witness points WP (which are generally referred to as the "knife edge" surfaces that together define the endpoints and the length of the tensioned string portion that resonates when played) formed on head HD mounted tuning screws TS at one end and on an integrally formed, movable bridge and tail piece BT tremolo or vibrato assembly that is actuated with a handle H and which is mounted at an opposite end to a solid body-type sound board SB of the electric guitar G. Those skilled in the art may be able to comprehend that the typical electric guitar will have a portion of such integrally formed tremolo assemblies BT that protrudes into a recess or cavity TR (FIG. 2) formed in the sound board body SB, which recess is generally accessible in many configurations from the rear of the instrument by removing an often-times flush mounted cover TC.

Figure 3:
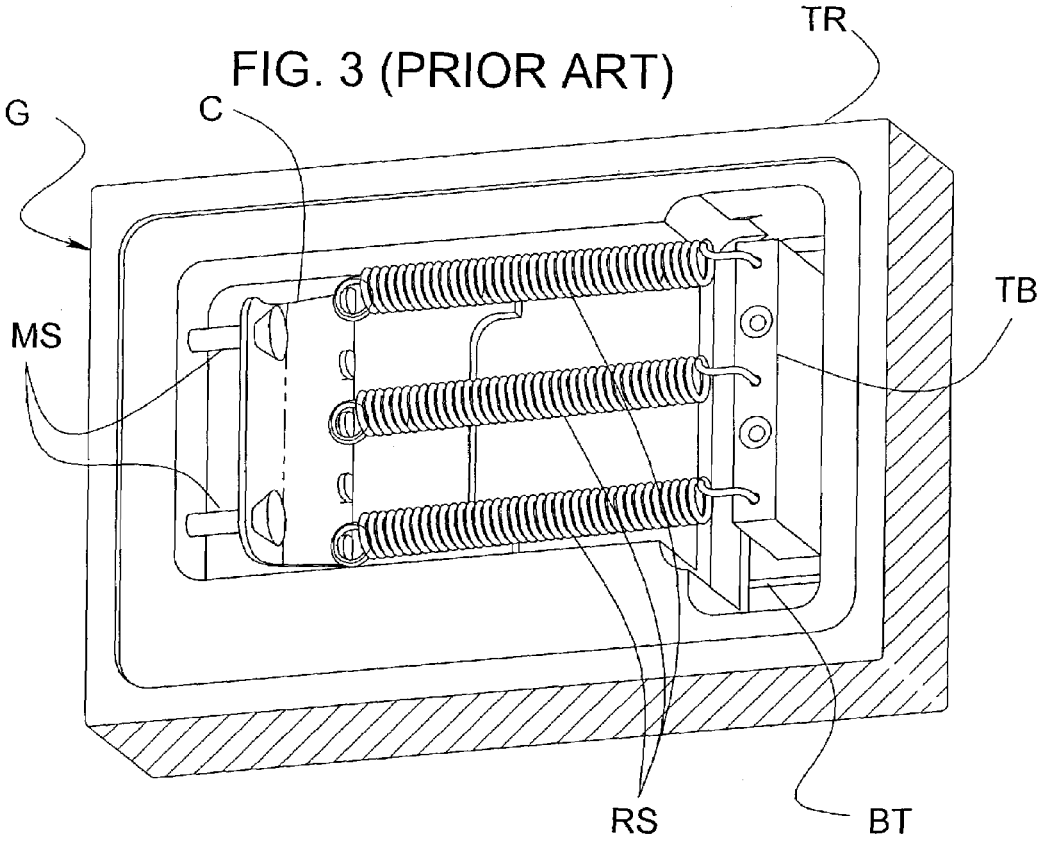
FIG. 3 (PRIOR ART)
FIG. 3 is an elevated perspective view, in enlarged scale and rotated, of a detail section view taken about view line 3—3 of a portion of the electric guitar of FIG. 2, with certain structure removed for illustration purposes, and shown with a prior art moving bridge and tail piece assembly, or a tremolo or vibrato effect assembly as such are commonly employed in the field.

With continued reference to FIGS. 1 and 2 and also now to FIG. 3, those having knowledge of the relevant arts may be able to understand that the typical configuration for many electric guitars in the prior art include a tremolo or vibrato assembly similar in many respects to that shown in the exemplary tremolo effects assembly recess or cavity TR of FIG. 3, which has the recess cover TC removed for illustration purposes. More specifically, in the prior art embodiment shown here, the installed and tuned strings S are tensioned to resonate at the desired frequencies and so as to balance the forces of one or more combined return springs RS that are installed generally as shown.

Figure 4:
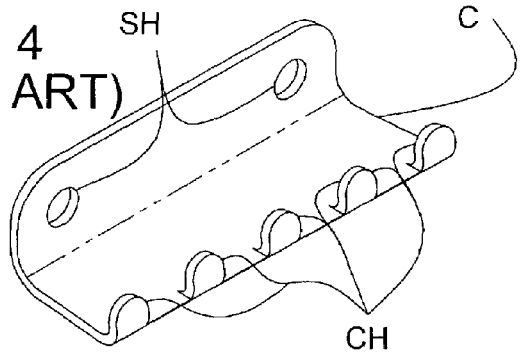
FIG. 4 (PRIOR ART)
FIG. 4 is an elevated perspective view, rotated and in enlarged scale, of a component of the prior art moving bridge and tail piece assembly, or a tremolo or vibrato effect assembly of FIG. 3.

As noted above, the integral tail piece and bridge assembly BT (FIGS. 1 and 3) is usually formed to have a portion that is often referred to by those skilled in the art as a tremolo block TB (FIG. 3), which is formed with one or more features adapted for connection to the return spring or springs RS. In the prior art tremolo recess or cavity TR of FIG. 3, and with reference also now to FIG. 4, the most commonly used modern-day tremolo or vibrato effects assemblies also incorporate a bent sheet metal claw C that is connected to a wall or surface within the tremolo recess or cavity TR with mounting screws MS that are received in corresponding screw holes SH formed in the claw C. The claw C is also usually formed with 5 claw-hooks CH that are each bent up to capture a respective loop end of one of the return springs RS. In the typical prior art configuration depicted in FIGS. 1 through 4, the return springs RS are arranged in a straight mode alignment. Some performers and manufacturers also employ what is commonly referred to as an arrow-head arrangement which slightly increases the spring forces induced into the assembly. The arrowhead arrangement is shown, for example, in FIG. 9 of U.S. Pat. No. 5,708,225 to Sherman, among others.

The new tremolo lock device of the instant invention is specifically illustrated herein as it has been adapted for use with the prior art tremolo and vibrato effect assemblies that are similar in configuration to that shown in FIGS. 1 through 4. Those skilled in the art should be able to comprehend that the inventive tremolo lock device can be installed without modification into the tremolo recess or cavity TR of FIG. 3 simply by removing the cover TC and the prior art claw C, installing the improved tremolo locking device, reattaching the return springs, and replacing the cover TC.

Figure 5:
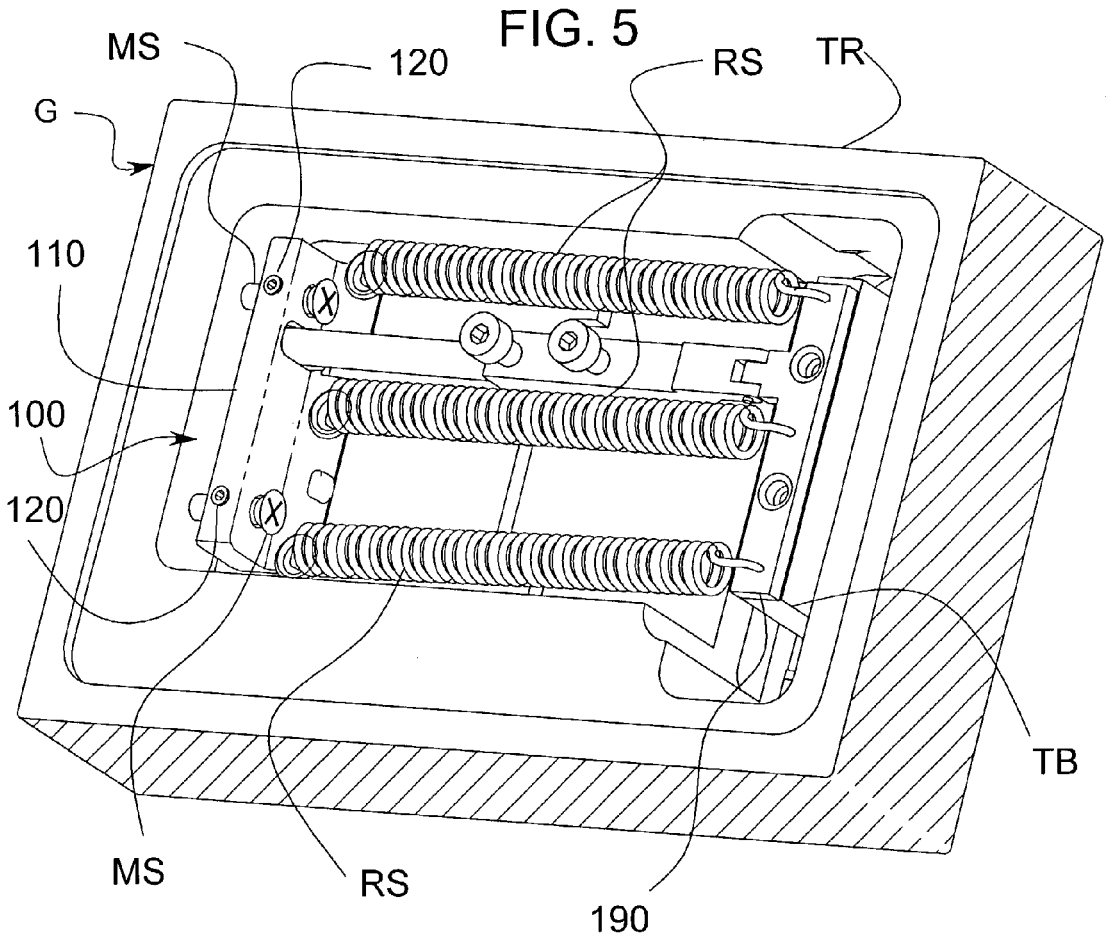
FIG. 5 is an elevated perspective view, rotated and in enlarged scale, of a portion of the structure of FIG. 3 shown installed with an embodiment of the quick-release tremolo lock device according to the principles of the instant invention.

With continued reference to FIGS. 1 through 4 and now also to FIG. 5, the innovative tremolo lock device 100 according to the features and capabilities of the invention is shown as installed in a typical 3 or 4 or 5-spring prior art tremolo recess or cavity TR with the industry standard return springs, which are in this embodiment shown to be tension springs, captured on the tremolo lock device 100. This configuration is used by many mass-production manufacturers, including for example Ibanez, an affiliate of Hoshino-Gakki, Ltd., among many, many others. While those having skill in the art should be capable of understanding these principles of fabrication and installation in the prior art recess TR configuration shown, more detailed and explanatory instructions are available to lay performers and those having interest but lacking detailed knowledge of the art from Tremol-no, LLC, P.O. Box 388, New Albany, Ohio, USA, and which can also be seen at www.tremolno.com, and which entity also supplies the inventive embodiments, described, illustrated, claimed, and contemplated in this application.

As stated elsewhere herein, although the context of the instant invention is explicated with great detail as regards such 3, 4, and 5-spring tremolo assemblies that are in common use in the guitar industry, the inventive tremolo lock devices according to the metes and bounds of the instant invention are compatible for use with and can be adapted for compatibility with many types of tremolo structures and assemblies that are in use with a wide variety of stringed instruments.

As depicted in the 3-spring configuration of FIG. 5, and with further reference now also being made to FIGS. 6 and 7, the novel tremolo lock device 100 incorporates a spring mount 110 that is adapted to replace the prior art claw C and which is configured with one or more mounting holes 115 adapted to connect with and be attached to the factory or manufacturer supplied tremolo recess TR mounting hardware as depicted in FIGS. 3 and 5 such as machine or wood bolts or screws MS. The spring mount 110 is further adapted to include one or more fasteners, thumb screws, wing-nut screws, cross-point or slotted or hex-key set screws, or similarly functioning and capable components 120, which components 120 can be received in and or engaged with the mount 110 and adjusted to capture the preexisting hardware, such as original equipment tremolo assembly mounting screws MS, whereby the spring mount 110 is securely and unmovably but releasably connected to and fixed relative to the supplied, preexisting manufacturer mounting hardware MS.

The spring mount 110 also preferably incorporates at least one, and as shown in FIG. 6, four features, such as posts, upwardly projecting posts, or other similarly capable hook, claw, or capture elements 125 that are formed in the mount 110 and configured to receive or capture an end of at least one respective return spring RS. Although shown in the various figures as integrally formed in the mount 110, the elements 125 can also be configured as generally upstanding fasteners received in the mount 110, as well as a variety of other equally effective elements that can be comprehended by those skilled in the art.

Figure 8:
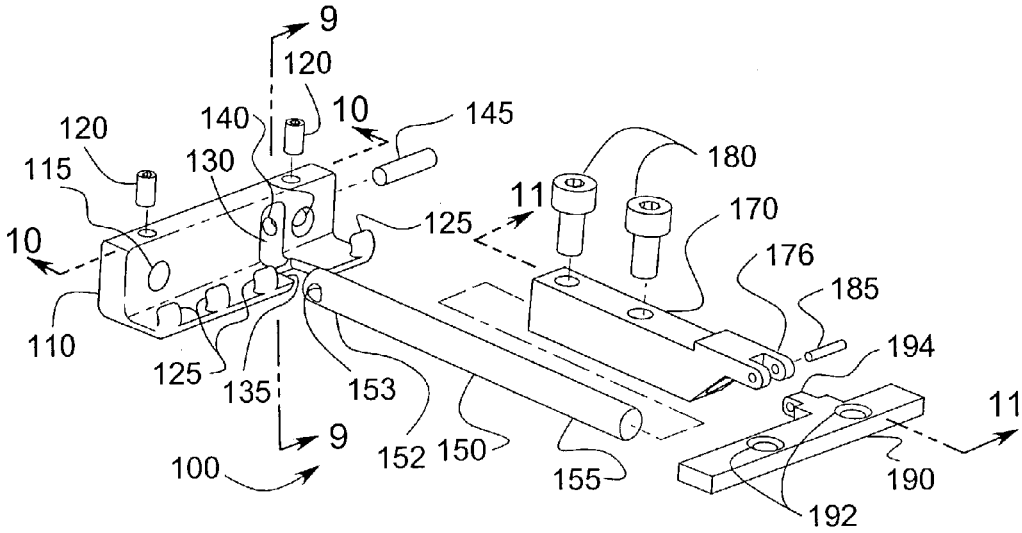
FIG. 8 is an exploded assembly view, rotated and in reduced scale, of the quick-release tremolo lock device embodiment of FIGS. 5, 6, and 7.
Figure 9:
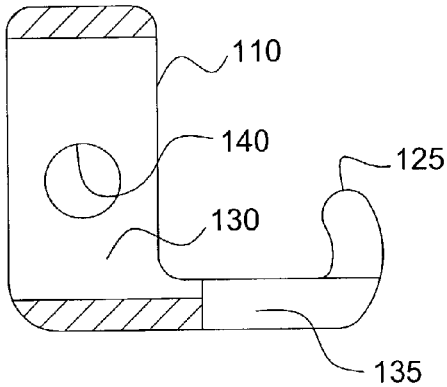
FIG. 9 is a cross-sectional view, in enlarged scale and rotated and taken about section line 9—9 of FIG. 8, of the spring mount component of the quick-release tremolo lock device embodiment of FIGS. 5 through 8.
Figure 10:
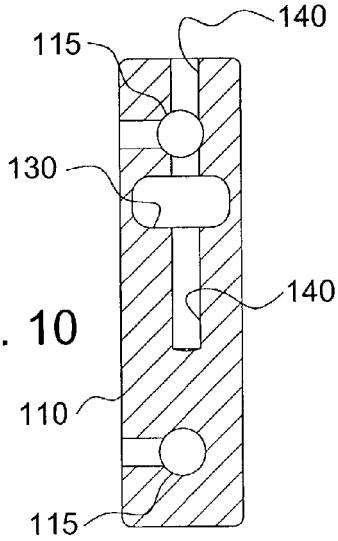
FIG. 10 is a different cross-sectional view, in enlarged scale and rotated and taken about section line 10—10 of FIG. 8, of the spring mount component of the quick-release tremolo lock device embodiment of FIGS. 5 through 9.

With reference next to FIGS. 8, 9, and 10, those with knowledge in the relevant arts may be able to appreciate that the spring mount defines a joint and or misalignment recess 130 and a slide key joint and or misalignment compensating recess 135 that cooperate with the other features and elements of the tremolo lock device 100 to establish the stated capabilities described herein. Also formed in the spring mount 110 is a set screw bore or journaling pin bore 140 that is adapted to receive a set screw or friction fit journal bearing pin 145 that connects the spring mount 110 to other components as described in the various figures and hereinbelow.

Figure 11:
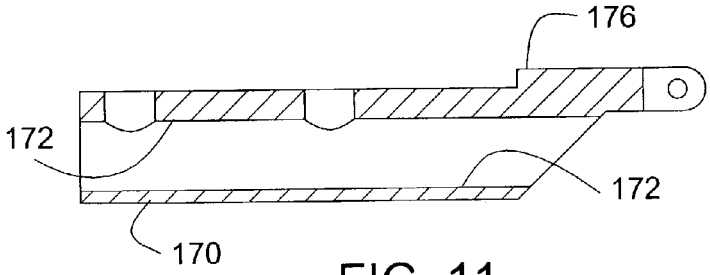
FIG. 11 is a cross-sectional view, in enlarged scale and rotated and taken about section line 11—11 of FIG. 8, of the slide key receiver component of the quick-release tremolo lock device embodiment of FIGS. 5 through 8.
Figure 18:
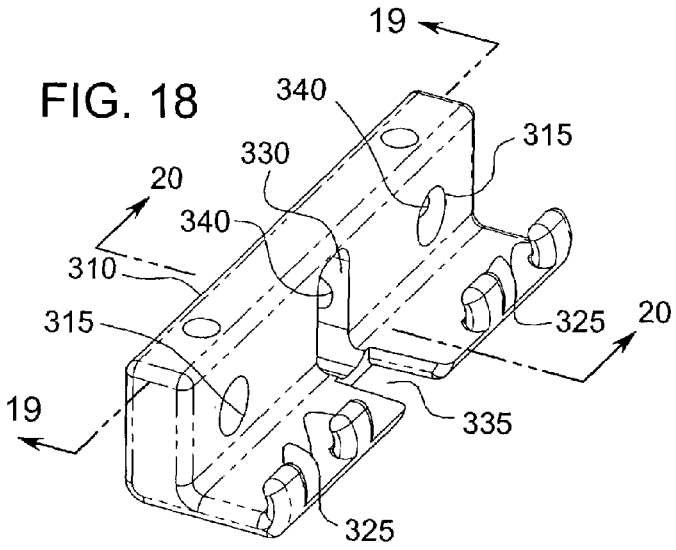
FIG. 18 is an elevated perspective detail view, in enlarged scale and rotated and with certain structure removed for illustration purposes, of a variation of and an alternative spring mount component of earlier illustrated embodiments and specifically depicts a more detailed view of the component as incorporated into the quick-release tremolo lock device embodiment of FIGS. 16 and 17.
Figure 19:
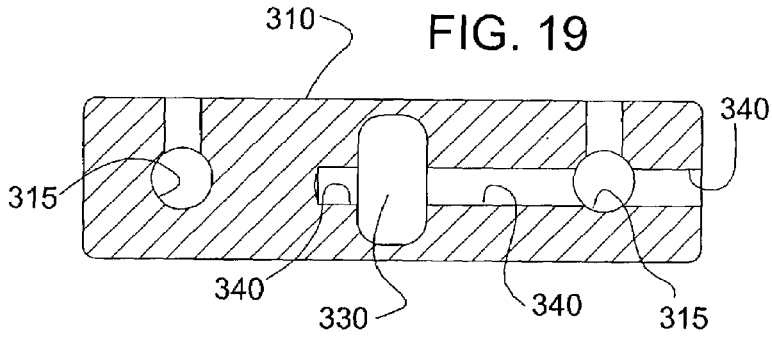
FIG. 19 is a section view, in enlarged scale, and rotated and taken about section line 19—19 of FIG. 18, of the alternative spring mount component of FIGS. 16 through 18.
Figure 20:
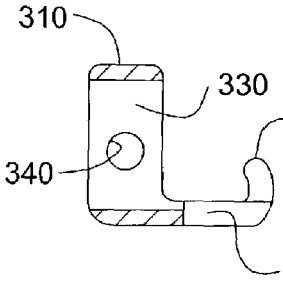
FIG. 20 is another section view, in similar scale to FIG. 19, and rotated and taken about section line 20—20 of FIG. 18, of the alternative spring mount component of FIGS. 16 through 19.
Figure 23:
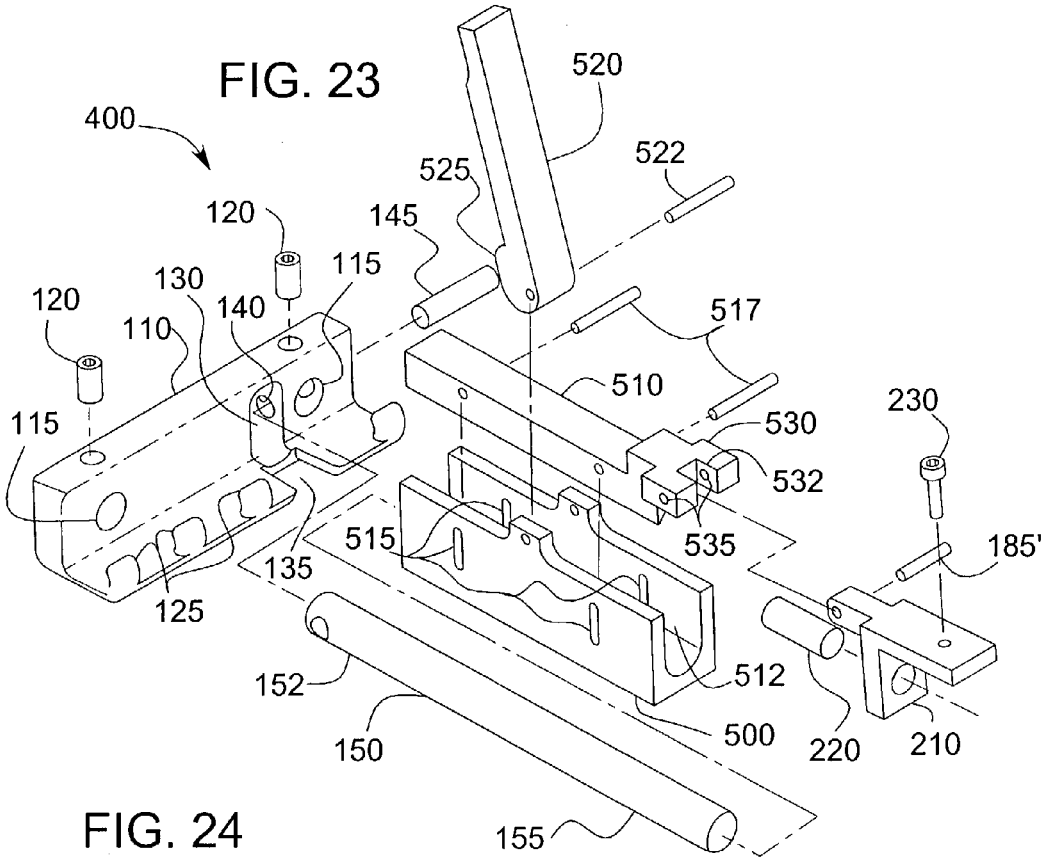
FIG. 23 is an exploded assembly view, rotated and in similar scale to that of FIGS. 21 and 22, of the variations, alternative arrangements, and modified configurations shown in those figures.
Figure 24:
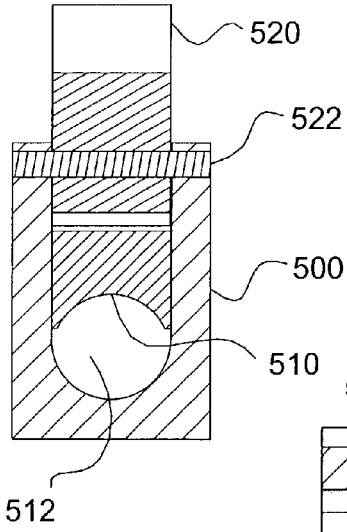
FIG. 24 is a cross-sectional view, in enlarged scale and rotated and taken about section line 24—24 of FIG. 21 and with certain structure removed for illustration purposes, of the tremolo lock device of FIGS. 21, 22 and 23.
Figure 25:
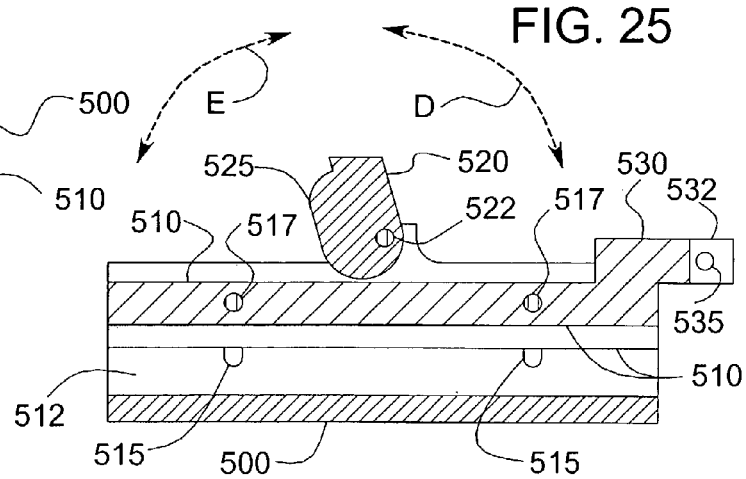
FIG. 25 is a different cross-sectional view, in enlarged scale and rotated and taken about section line 25—25 of FIG. 21, also with various structure removed for purposes of illustration of the tremolo lock device of FIGS. 22 through 24.

As can be understood with continued reference to FIGS. 6, 7, 8, 9, 10, and also now FIG. 11, the screw or pin 145 is adapted to also be received within a bore 153 (FIG. 8) formed in a proximate portion 152 of a slide key 150, which is thereby captured and connected to the spring mount 110. The bore 153 can be sized and formed to have a shape that can establish varying and predetermined movement in one or more degrees of freedom whereby the slide key 150 is movable free from interference with the spring mount 110 but within the confines of the recesses 130, 135 defined in the spring mount 110. As can be understood by those knowledgeable in the pertinent fields, the recesses 130, 135, the size, shape, and cross-sectional profile of the slide key 150, and the sizes of the bore 153 and the screw or pin 145 can be adjusted to establish a joint between the noted components that is specially adapted and configured to further control, establish, limit, decrease, and or increase the range of movement in the various possible degrees of freedom. The instant invention also contemplates very tightly controlled dimensional tolerances whereby the possible degrees of freedom of movement between the spring mount 110 and the slide key 150 are carefully controlled so as to minimize and even to eliminate any such movement or degrees of freedom. Also, in either limited movement or many degree of freedom configurations, when the inventive tremolo lock device 100 is installed but disengaged so that the slide key 150 is free to move relative to a slide receiver 170, then the tremolo assembly BT of the host stringed instrument such as guitar G can be used during performances without impediment. More specifically, the various contemplated embodiments of the invention enable heretofore unavailable modes of operation that not only can be installed without modification to the host stringed instrument, but which can remain installed without any impact to performances that require tremolo effects during various passages.

A distal portion 155 of the slide key 110 is preferably slidably and adjustably received in quick release slide receiver 170, which is also incorporated into the various embodiments of the preferred tremolo lock device, including lock device 100. The quick release slide receiver 170 is configured to adjustably and slidably receive and releasably capture the distal portion 155 of the slide key 150 within a recess or raceway 172 that is integrally formed in the slide receiver 170. When engaged, the quick release slide receiver 170 fixes the relative position between the slide key 150 and the slide receiver 170. Although many possible means are known in the art and available and within the knowledge of those practicing in the relevant fields, one possible means by which the slide receiver 170 can be configured to releasably capture the slide key 150 includes fasteners or set screws, or thumb-wheel or wing-nut head type fasteners that can be received within threaded recesses defined in the slide receiver 170. This particular threaded fastener configuration is illustrated in some of the various figures, including for purposes of example without limitation, FIGS. 6, 7, 8, and also more specifically in the superior portion of the cross-sectional illustration of FIG. 11.

Although the exemplary slide key 150 and slide receiver 170 components are shown to preferably be generally cylindrical in configuration, any of a number of other equally suitable arrangements are contemplated and have been found to be well-suited for incorporation into the various embodiments of the present invention. In the cylindrical arrangement depicted generally in the various figures, the slide key 150 may rotate relative to the race way 172 of the slide receiver 170. This capability is particularly useful for applications that require compensation for misalignment that may be present in the host stringed instrument, such as an electric guitar G. In this way, the tremolo lock device according to the principles of the present invention establishes another degree of freedom of movement between the slide receiver 170 and the slide key 150. Thus, those having an understanding of the technology in the field of the invention may appreciate that, in combination with the other features and capabilities already described, at least 4 degrees of freedom of relative movement can be established between the slide key 150 and the slide receiver 170. Specifically, the slide key 150 can move relative to the slide receiver 170 in various directions: 1) laterally or yaw (over sizing of bore 153 enables side to side movement of the key 150 about an intersection point of the axis of pin or screw 145 and the axis of the slide key 150); 2) longitudinally (the slide key 150 can be slidably received in the race way 172 of the slide receiver 170 to vary the distance from the spring mount 110); 3) pitch (selective size selection of the slide 150, bore 153, the pin or screw 145, and the recesses 130, 135 enable rotation of the slide key 150 about the pin or screw 145); and 4) roll (the slide receiver 170 receives the slide key 150 in a manner that enables relative rotation of the slide receiver 170 about the key 150). Additional degrees of freedom of movement are also further contemplated by the invention and some of them are further described and illustrated in more detail hereinbelow.

Many applications exist for use of the many various preferred embodiments of the instant in stringed instruments that require limitation of the possible ranges of motion. According to these aspects of the present invention, the shape of the slide key 150 can also be configured to have a cross-sectional profile that is rectilinear, trapezoidal, triangular, ovoid, teardrop, polygonal, star-shaped, or any of a wide array of possible cross-sectional profiles. Even further preferred configurations can include, for further purposes of example without limitation, any of such noted and contemplated cross-sectional profiles that further incorporate raised boss or extruded elements that project outwardly from the surface of the key 150 and that run generally longitudinally and in parallel to the axis of the key 150. Such keyed or raised boss elements can be preferably keyed to correspondingly shaped recesses or keyways that can be formed in and defined on the interior race way or face 172 of the slide receiver 170. These contemplated elements can thereby cooperate to thereby constrain freedom of rotational relative movement between the slide receiver 170 and the slide key 150 in applications that require limitation of such relative movement. Many terms of art are used by those having skill in the art to refer generally to such features, capabilities, and elements and can include, for purposes of further explication, tongue and groove elements, keyed bosses and broached keyways, and similar and synonymous terms.

The slide receiver 170 is also formed with a clevis portion 176 that is sized to receive a corresponding tongue element of additionally cooperative features of the novel and inventive tremolo locking device 100. More specifically, and with continued reference to the various figures and especially now FIGS. 6, 7, and 8, the instant invention also further incorporates at least one of many possible tail pieces, such as tail piece 190, that are preferably configured to, among other capabilities, connect the slide receiver 170 to the movable tail piece and bridge assembly BT (FIGS. 1 and 3), that is also referred to here and by those skilled in the art as a "tremolo block" or "trem-block." For purposes of explanation and to provide a very specific example of a tail-piece that has been adapted to be compatible for use with a specific stringed instrument, the tail piece 190 is shown to be configured for use with a variety of electric guitars available from various sources, including specifically those available from Ibanez (Hoshino-Gakki, Ltd.) in what is commonly referred to as a "3-spring" configuration. As those skilled in the arts may understand and know from reference to this description and the accompanying figures, this same configuration is also compatible for use with a wide variety of 4 and 5-spring, as well as other types of return-spring-type tremolo assemblies available from many such manufacturers.

This particular tail piece 190 of FIGS. 6, 7, and 8 is adapted with trem-block mounting recesses 192 and a protruding tongue element 194. As shown, the recesses 192 that are defined in the tail piece 190 can be directly fastened to the tremolo-block TB of many such Ibanez and other manufacturer original equipment and customized electric guitars without the need to modify the guitar in any way. The original, industry standard springs can be used as well and as further noted hereinbelow. Additionally, one or more recesses 196 (FIG. 7) can be formed in a surface of the tail piece 190 to capture the return springs RS against the tremolo-block TB. The tongue 194 is received between the tines of clevis 176 and is captured with pin or set screw 185 to form a joint that can be configured for fixed position or for one or more possible degrees of freedom of movement relative to the slide receiver 170. As depicted in the various figures, at least two degrees of freedom of such relative movement are possible if desired for the particular application. With the appropriate selection of size for the pin or screw 185 and corresponding recesses in the clevis 176 and the tongue 194, one degree of freedom includes the capability for the tail piece 190 to rotate about the axis of the pin 185. With similarly preselected size arrangements of the tongue 194 and the recess defined by the tines of the clevis 176, the tail piece 190 may be configured to slide along the axis of the pin 185. Additionally, by selecting an over sized bore to be formed in the tongue 194 to receive the pin 185, the tail piece 190 can be further configured to capable of lateral and yaw motion similar to that described hereinabove in connection the joint defined between spring mount 110 and the proximate portion 152 of the slide key 150.

As those skilled in the art should now be capable of understanding after absorbing the description of the preferred embodiments of the invention, many possible tail pieces are contemplated by the instant invention, and which can be configured for compatibility with many stringed instruments, including the electric guitar configurations described here. The preferred arrangement described in connection with FIGS. 6, 7, and 8 is primarily directed to use with an electric guitar G such as the manufacturer guitar models contemplated above and elsewhere herein. In operation, the musician would install the novel tremolo lock device 100 of these figures into the tremolo recess TR as noted above in more detail.

Once the inventive tremolo lock device 100 is installed, the musician would then install 1 or 2 of the return springs RS as desired and possibly about the outer most elements or claws 125, with a third RS return spring being preferably installed about the central most element or claw 125. Then, when it is desirable to secure the tremolo assembly BT in a fixed position so as to disable the tremolo capability of the stringed instrument, such as guitar G, one or both of the fastener elements 180 would then be engaged with the assembly BT in a neutral position. Once the fasteners 180 were thereby engaged, the tremolo function of the instrument is no longer operable. Even if a string breaks during a performance, the inventive tremolo lock device 100 would prevent movement of the tremolo assembly BT despite the now unequal forces between the remaining strings and the return springs RS. In reverse operation, when it is desirable to use the tremolo capability of the stringed instrument, such as guitar G, the musician would simply disengage fastener(s) 180 so as to re-enable movement of the tremolo assembly BT by use of the handle H.

Although one exemplary embodiment of the invention has been described in detail with respect to one particular type of electric guitar in the industry, those skilled in the relevant and related arts should know that many other manufacturers in addition to Ibanez also employ a 3-return-spring configuration, which is often referred to by expert manufacturers and musicians practicing in the field as a "vintage" 3-spring configuration. Even further, those with particular skills can also appreciate that such configurations are often interchangeable with 4 and 5-spring assemblies as well as with other types of differently configured spring type tremolo assemblies and components. Such vintage 3, 4, and 5-spring guitar models can incorporate, among other elements, movable bridge and tremolo assemblies similar in capability to that shown in the various figures. With continued reference to the various figures, and now also specifically to FIGS. 12, 13, 14, and 15, those skilled in the art may comprehend that an alternative inventive tremolo lock device 200 can be configured to incorporate a tail piece 210. This modified tail piece 210 can be connected to the original equipment and custom manufacturer tremolo block in many vintage 3-spring and 4-spring electric guitar models without the need to make any modifications to such guitars. Additionally, although not reflected in the various embodiments of tail piece 210, the instant invention contemplates that this particular embodiment of tail piece 210 can be modified and varied to incorporate one or more features of previously illustrated tail piece 190 including the return spring recesses 196 (see, for purposes of example without limitation, FIG. 7) among other features, elements, and capabilities.

In fact, this specific alternative preferred modification incorporates the interchangeable tail piece 210 adapted with one or more set screws and the like for connecting the tail piece 210 via a tail tongue 215 to the trem-block of any of a number of such vintage 3-spring and 4-spring and other guitar models. For purposes of further example, but not for purposes of limitation, the tail piece 210 is also shown adapted to incorporate a set screw 220 that is configured to interface with a side of the trem-block, such as a modified trem-block TB, and a set screw 230 that can interface and connect to the contemplated trem-block in a way similar to that of the previously described tail piece 190.

As before, the modified tail piece 210 is preferably joined to the slide receiver 170 with the tongue of the tail piece 210 received within the clevis 176 and captured by screw or pin 185. Here again, the joint formed between the tail piece 210 and the slide receiver 170 can be configured for fixed position applications as well as for multiple degree of freedom applications that can, among other capabilities, enable use of the inventive tremolo lock devices 100, 200 in misalignment compensating applications. Moreover, when the trem-block lock devices 100, 200 are operated in the disengaged mode, the various joints, including the joint between the tail pieces 190 or 210 and the slide receiver 170, can be configured to freely move and rotate to enable impediment free operation of the tremolo assembly of the host stringed instrument.

In yet another possible modified arrangement of elements, the contemplated tremolo lock device of the instant invention is also directed to stringed instruments that include a genre of electric guitars that incorporate tremolo assemblies having 4 or more return springs, such as return springs RS. With continued reference to the many figures and illustrations and with specific reference now also to FIGS. 16, 17, 18, 19, and 20, those competent to practice in the relevant fields of art may come to understand that the invention can be further modified as depicted by tremolo lock device 300. In this alternative preferred arrangement, a spring mount 310 is adapted with similar and modified components and elements to spring mount 110, and as identified by reference numerals 315 (mounting holes), 325 (spring capture, hook, or claw elements), 330 (misalignment and or joint recess), 335 (slide key mounting and or misalignment compensating recess), and 340 (modified set screw bore or journaling pin bore) which are similar to the features illustrated with respect to spring mount 110 and the similar features respectively identified therein by reference numerals 115, 125, 130, 135, 340. More particularly, it can be observed that the spring capture, hook, or claw elements 325, the bore 340, and the joint and or misalignment compensation recesses 330, 335 are rearranged relative to those comparable features of the earlier described spring mount 110.

Even though it is possible for the earlier illustrated spring mount 110 to capture 4 springs, in this alternative arrangement of FIGS. 16 through 20, the spring mount 310 arranges at least 4 such return springs RS in an even more preferred 4-spring configuration wherein at least one return spring can be received on or captured by the elements 325. The modified spring mount 310 of this tremolo lock device 300 is shown with the vintage-type tail piece 210. However, many such tail pieces are compatible for use herewith and the tail piece 210 is not the only possible means by which the tremolo lock device can be connected to the contemplated vintage tremolo block assemblies of the host stringed instrument.

The instant invention also contemplates various alternative arrangements of other components and elements. In addition to continuing references to earlier illustrations, specific reference is now also made to FIGS. 21, 22, 23, 24, and 25. In these figures, yet another possible configuration of the contemplated invention is depicted to include a modified clamping slide receiver. Such a reconfigured preferred tremolo lock device 400 incorporates various features and elements from any of the previously illustrated embodiments as well as additionally new and inventive features and components wherein similar or identical reference numerals identify parts, components, and features as already described. Although similar in many functional respects to components discussed earlier herein, a modified and even more preferable slide receiver 500 is depicted that enables quick release and engagement, as similarly described in connection with previous embodiments, modifications, and alternative embodiments, of any of the inventive tremolo lock devices 100, 200, 300, as well as the lock device 400 shown here.

The alternative preferred slide receiver 500 is an over center type latch mechanism that incorporates a clamp key 510 that is received in a race way 512 formed in the receiver 500. The clamp key 510 can preferably be stabilized in the race way 512 when slots 515 are formed in the walls of the race way 512 to receive pins or screws 517 that can capture the clamp key 510 as shown in the figures. Other possible stabilizing capabilities and features can include, for purposes of further illustration without limitation, any of the key-keyway, tongue and groove, and raised boss-notch type features disclosed above in connection with the slide key 150 and slide receiver 170 configurations. Such additionally desirable features and elements can be used either alone or in combination with the proposed slots 515 and pins or screws 517 shown here.

Further, when a slide key such as slide key 150 is received in the race way 512, the novel quick release and engage slide receiver 500 can further preferably incorporate a clamp lever 520 that can be connected to the receiver 500 with a clamp-lever-cam-follower pin or screw 522. The clamp lever can also further incorporate a cam 525 that, when the clamp lever 520 is actuated in the direction shown in the figures and over its generally upright and centered position, forces the clamp key into frictional engagement with the slide key 150 to releasably latch the slide key 150 to prevent sliding or rotational movement relative to the race way 512 of the modified slide key receiver 500. In this arrangement, the clamp key 510 operates much like a cam follower found in various automotive and other dynamic mechanical devices. Here, during operation, the slots 515 enable controlled movement of the cam following clamp key 510 when the clamp lever 520 is actuated to a slide receiver "engaged" position, denoted generally by the arrow labeled "E," from a disengaged position that is denoted generally by an arrow labeled "D" (See FIGS. 21, 22, and 25). The modified configuration of the slide receiver 500 may also preferably incorporate a modified tail piece joint portion 530 having tines forming a clevis 532 and pin or screw recesses 535 adapted to receive and capture the pin or screw 185' for connecting a tail piece such as tail piece 210 to the alternative slide receiver 500.

As can be appreciated by those having skill in the relevant arts and experience in the various related fields of technology, the tremolo lock device embodiments, variations, alternatives, configurations, and modifications set forth here and contemplated by the instant invention have wide utility and application to any stringed instruments that incorporate tremolo and vibrato assemblies. Here again, although the various illustrations and embodiments herein describe the details of the contemplated invention in the context of guitars and related stringed instruments, the inventive tremolo lock devices are contemplated for adaptation and use with all of the stringed instruments described hereinabove, and which are used for many types of musical performances.

Numerous alterations, modifications, and variations of the preferred embodiments disclosed herein would be apparent to those skilled in the art and they are all contemplated to be within the spirit and scope of the instant invention, which is limited only by the following claims. For example, although specific embodiments have been described in detail, those with skill in the art can understand that the preceding embodiments and variations can be modified to incorporate various types of substitute and/or additional materials, relative arrangement of components, features, elements, and dimensional configurations for compatibility with the wide variety of possible stringed instruments that are in wide spread use in the industry. Accordingly, even though only few such embodiments, alternatives, variations, and modifications of the present invention are described herein, it is to be understood that the practice of such additional modifications and variations and the equivalents thereof, are within the spirit and scope of the invention as defined in the following claims.

I claim:

1. A releasable tremolo lock device for installation into a tremolo assembly recess of a stringed instrument, comprising:

a spring mount bar adapted to be connected to a wall of the tremolo recess and to capture an end of at least one tension spring;

a slide key mounted about a proximate end to the spring mount bar;

a quick release slide receiver adapted to slidably receive a distal portion of the slide key and to releasably capture the slide to fix the position of the receiver relative to the slide key; and a tail piece joined to the quick release slide receiver and adapted to be mounted in the tremolo recess to a tremolo block of the guitar.

2. The releasable tremolo lock device of claim 1, wherein the slide key is rotatably mounted to the spring mount bar with a joint adapted to move in at least one degree of freedom relative to the spring mount bar.

3. The releasable tremolo lock device of claim 1, wherein the slide key is rotatably mounted to the spring mount bar with a joint adapted to move in at least two degrees of freedom relative to the spring mount bar.

4. The releasable tremolo lock device of claim 1, wherein the slide key is releasably captured by and fixed in position relative to the quick release slide receiver by at least one fastener received in the receiver and adapted to be tightened into a friction imposing relationship against the slide key.

5. The releasable tremolo lock device of claim 1, wherein the slide key is releasably captured by and fixed in position relative to the quick release slide receiver by at least one over center type latch mounted to the receiver and adapted to be actuated into a friction imposing relationship against the slide key.

6. The releasable tremolo lock device of claim 1, wherein the tail piece is joined to the quick release slide receiver with a joint adapted to move in at least one degree of freedom relative to the receiver.

7. The releasable tremolo lock device of claim 1, wherein the tail piece is joined to the quick release slide receiver with a joint adapted to move in at least two degrees of freedom relative to the receiver.

8. A releasable tremolo lock device for installation into a tremolo assembly recess of a guitar, comprising:

a spring mount bar adapted to be connected to a wall of the tremolo recess and formed with a plurality of claw-hooks each adapted to capture an end of a tension spring that is distally mounted to a tremolo block protruding into the assembly recess;

a slide key mounted about a proximate end to the spring mount bar;

a quick release slide receiver adapted to slidably receive a distal portion of the slide key and to releasably capture the slide to fix the position of the receiver relative to the slide key; and a tail piece joined to the quick release slide receiver and adapted to be mounted in the tremolo recess to the tremolo block.

9. The tremolo lock device of claim 8, wherein the slide key is rotatably mounted to the spring mount bar with a joint that is configured to move in at least one degree of freedom relative to the spring mount bar.

10. The tremolo lock device of claim 8, wherein the slide key is rotatably mounted to the spring mount bar with a joint that is configured to move in at least two degrees of freedom relative to the spring mount bar.

11. The tremolo lock device of claim 8, wherein the slide key is releasably captured by and fixed in position relative to the quick release slide receiver by at least one fastener received in the receiver and adapted to be tightened into a friction imposing relationship against the slide key.

12. The tremolo lock device of claim 8, wherein the slide key is releasably captured by and fixed in position relative to the quick release slide receiver by at least one over center type latch mounted to the receiver and adapted to be actuated into a friction imposing relationship against the slide key.

13. The tremolo lock device of claim 8, wherein the tail piece is joined to the quick release slide receiver with a joint that is configured to move in at least one degree of freedom relative to the receiver.

14. The tremolo lock device of claim 8, wherein the tail piece is joined to the quick release slide receiver with a joint that is configured to move in at least two degrees of freedom relative to the receiver.

15. A releasable tremolo lock device for installation into a tremolo assembly recess of a stringed instrument, comprising:

a spring mount adapted to be fixably mated to a wall of the tremolo recess to prevent relative motion therebetween and to capture an end of at least one biasing member;

a slide key mated about a proximate portion to the spring mount;

a quick release slide receiver adapted to adjustably receive and to releasably capture a distal portion of the slide key to fix the position of the receiver relative to the slide key; and a tail piece joined to the quick release slide receiver and adapted to be mated to a tremolo block protruding into the tremolo recess of the guitar.

16. The tremolo lock device of claim 15, wherein the slide key is movably mated to the spring mount to move in at least one degree of freedom relative thereto.

17. The tremolo lock device of claim 15, wherein the slide key is releasably mated in a fixed position relative to the quick release slide receiver by at least one fastener engaging the receiver and adapted to be tightened into a friction imposing relationship against the slide key.

18. The tremolo lock device of claim 15, wherein the slide key is releasably captured and fixed in position relative to the quick release slide receiver by at least one over center type latch mounted to the receiver and adapted to be actuated into a friction imposing relationship against the slide key.

19. The tremolo lock device of claim 15, wherein the tail piece is joined to the quick release slide receiver with a joint that is configured to move in at least one degree of freedom relative to the receiver.

20. The tremolo lock device of claim 15, wherein the tail piece is joined to the quick release slide receiver with a joint that is adapted to be adjustable in at least two degrees of freedom to compensate for natural and induced misalignment between the tremolo lock device, the wall of the tremolo recess, and the tremolo block.

* * * * *